United States Patent [19]

Miyaki et al.

[11] Patent Number: 4,766,859

[45] Date of Patent: Aug. 30, 1988

[54] LUBRICATING SYSTEM FOR VERTICAL SHAFT ENGINE

[75] Inventors: Mutsuaki Miyaki; Yoshimi Tachibana; Kiyohiko Oguri; Yoshiharu Isaka, all of Iwata, Japan

[73] Assignee: Yamaha Hatsudoki Kabushiki Kaisha, Iwata, Japan

[21] Appl. No.: 77,619

[22] Filed: Jul. 24, 1987

[51] Int. Cl.[4] ..... F01M 1/00

[52] U.S. Cl. ..... 123/196 W; 123/196 R; 184/11.1; 184/13.1

[58] Field of Search ..... 123/196 R, 196 W; 184/11.1, 13.1

[56] References Cited

U.S. PATENT DOCUMENTS

| | | | |
|---|---|---|---|
| 2,449,227 | 9/1948 | Hobart | 184/13.1 |
| 2,669,322 | 2/1954 | Brown | 184/13.1 |
| 3,144,097 | 8/1964 | Ebert | 123/196 W |
| 3,529,698 | 9/1970 | Nelson | 184/13.1 |
| 3,847,249 | 11/1974 | Oehring | 184/11.1 |
| 4,426,964 | 1/1984 | Umeda et al. | 184/13.1 |
| 4,628,878 | 12/1986 | Nakamo et al. | 184/11.1 |

*Primary Examiner*—E. Rollins Cross

*Attorney, Agent, or Firm*—Ernest A. Beutler

[57] ABSTRACT

A vertical shaft internal combustion engine particularly adapted for powering a rotary type lawn mower. The engine is provided with a baffled crankcase so as to minimize the adverse effects of oil "sloshing" within the crankcase while, at the same time, permitting flow between the baffles. In addition, an oil slinger arrangement is incorporated that is also baffled so as to reduce frothing in the crankcase to reduce aeration of the oil in the crankcase and also to direct the oil flow from the slinger.

20 Claims, 5 Drawing Sheets

12
32
34
35
36
39
42
43
51
52
54
55
56
57
58
59
60
61
62
63
64
65
66
67
68
69
70
71
73
74
8

LUBRICATING SYSTEM FOR VERTICAL SHAFT ENGINE

BACKGROUND OF THE INVENTION

This invention relates to a lubricating system for a vertical shaft engine and more particularly to an improved lubricating system for use with a walk-behind lawn mower or similar implement.

In a large number of applications, an internal combustion engine is operated with its output shaft extending in a vertical direction. Examples of such applications are found in rotary lawn mowers wherein the grass is cut by a cutting blade that rotates about a vertically extending axis and is driven by an engine having its output shaft similarly disposed. Such an arrangement offers considerable utility because the engine output shaft can be directly coupled to the cutting blade shaft without the necessity of intervening transmissions or gear reduction units. When such an arrangement is employed, the output shaft passes through the center of the engine crankshaft. This presents certain problems in connection with the lubrication of the engine, particularly when the engine has a splash-type lubrication system.

Specifically, this type of orientation results in a crankcase that has relatively shallow height and a large cross-sectional area in a horizontally extending plane. As such, the depth of the lubricant in the crankcase can differ significantly when the engine is in motion and the "sloshing" of the lubricant can result in inadequate lubrication under these conditions.

It is, therefore, a principle object of this invention to provide an improved vertical shaft engine and lubricating system for such an engine.

It is another object of this invention to provide an improved arrangement for lubricating a vertical shaft engine.

It is yet a further object of this invention to provide an improved lubricating system for a vertical shaft engine wherein a splash-type lubrication system is employed.

In connection with splash lubricated internal combustion engines, it has been proposed to employ an oil slinger which is driven from the engine output shaft or an engine accessory shaft and which dips into the lubricant into the crankcase and throws it onto certain components of the engine to be lubricated. Although such an arrangement is effective in insuring adequate lubrication of all components of the engine with a splash-type system, there are certain disadvantages. First of all, the motion of the engine can cause the slinger to be immersed at different levels in the lubricant and the spray pattern will differ depending upon the degree of immersion. Furthermore, the operation of the slinger in the crankcase can tend to cause foaming of the lubricant in the crankcase that can adversely affect the lubrication of other components in the engine.

It is, therefore, a still further object of this invention to provide an improved a splash lubricating system of the type employing an oil slinger.

It is a yet further object of this invention to provide a baffling arrangement for an oil slinger that will control the direction of flow of the oil and will minimize the frothing of the oil in the crankcase.

SUMMARY OF THE INVENTION

A first feature of this invention is adapted to be embodied in a lubricating system for an internal combustion engine having an output shaft rotating about a generally vertically extending axis. A lubricant reservoir is defined at least in part by a lower wall of the engine which surrounds the engine output shaft and through which the output shaft passes for driving a driven element. The wall is formed with an upwardly extending baffle for dividing the lubricant reservoir into separate sections and for reducing "sloshing" of the lubricant within the lubricant reservoir. Oil passage means extend through the wall for permitting lubricant to flow through.

Another feature of the invention is adapted to be embodied in a lubricating system for an internal combustion engine having a generally horizontally disposed cylinder extending from a crankcase and a crankshaft journal for rotation within the crankcase about a generally vertically extending axis. An oil slinger is rotatable about an axis disposed at an angle to the horizontal and vertical and is driven by the crankshaft. The oil slinger axis is disposed for directing lubricant thrown by the slinger toward a component of the engine to be lubricated. In accordance with this feature of the invention, a baffle is contained within the crankcase and juxtaposed to the slinger for controlling the oil movement.

DETAILED DESCRIPTION OF THE PREFERRED EMBODIMENT OF THE INVENTION

Figure 1:
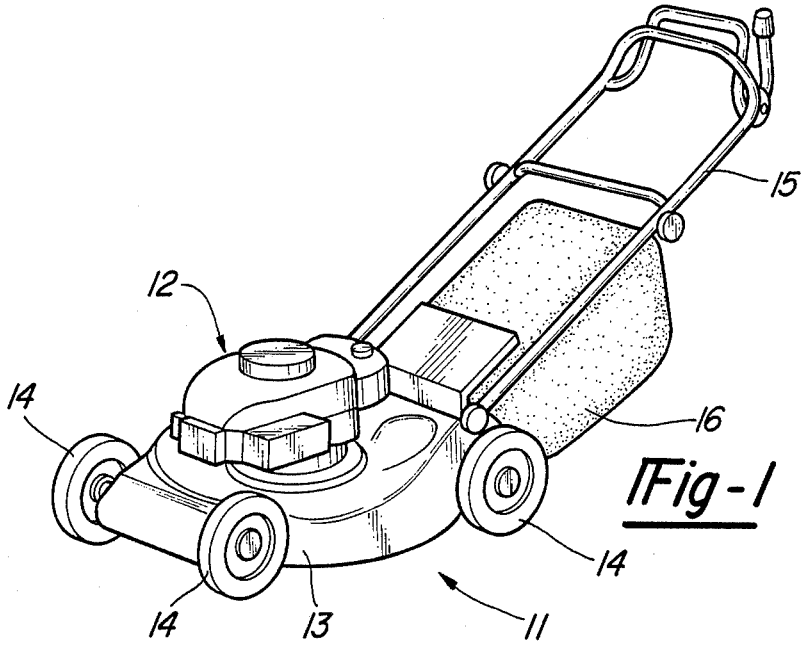
FIG. 1 is a perspective view of a walk-behind type of lawn mower powered by an internal combustion engine constructed in accordance with an embodiment of the invention.

Referring first to FIG. 1, a walk-behind lawn mower of the rotary type is identified generally by the reference numeral 11. The lawn mower 11 illustrates a typical environment in which the invention may be employed. The invention relates particularly to an internal combustion engine 12 that is utilized for operating the lawn mower 11. Although the invention is described in conjunction with a rotary-type lawn mower, it is to be understood that the invention is directed primarily toward the lubrication system of the engine 12 and that the invention has particular utility in a wide variety of other applications. However, the invention is particularly useful in connection with applications wherein the engine 12 is disposed so that its output shaft rotates about a generally vertically extending axis.

The lawn mower 11 further includes a main body portion 13 that houses a rotary cutting blade (not shown) that rotates about a vertically extending axis.

The cutting blade is rotatably coupled to the output shaft of the engine 12 in a known manner.

Four wheels 14 are journaled at the corners of the housing 13 so that the mower 11 may be moved along the ground. A handle 15 is provided so that an operator can stand behind and manipulate the mower 11. In the illustrated embodiment, the mower 11 is of the rear-discharge type and a catcher bag 16 is supported beneath the handle assembly 15 for catching the rearwardly thrown grass clippings.

Figure 2:
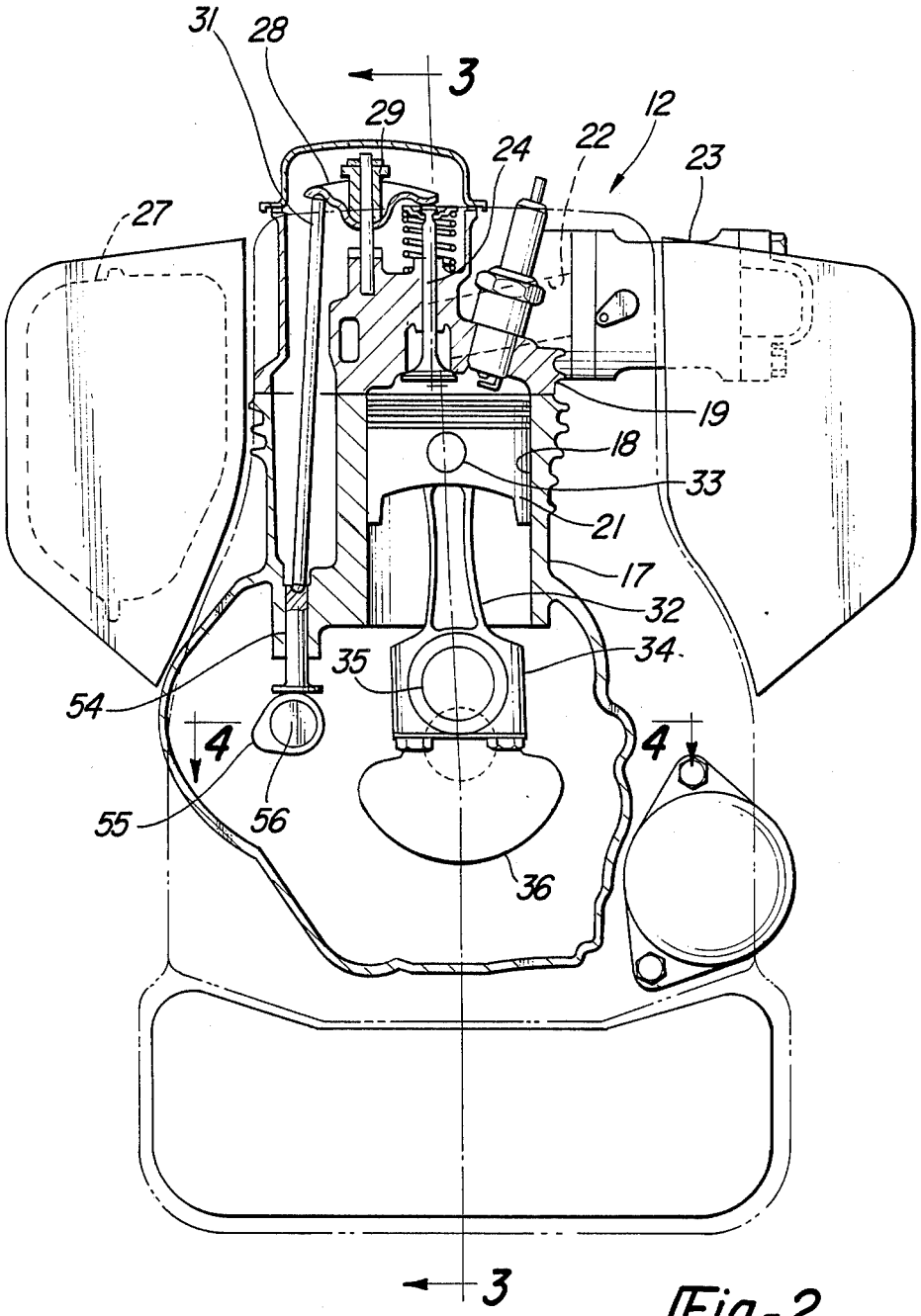
FIG. 2 is an enlarged cross-sectional view taken along a horizontal plane showing the engine, with certain of the components being shown in phantom.
Figure 3:
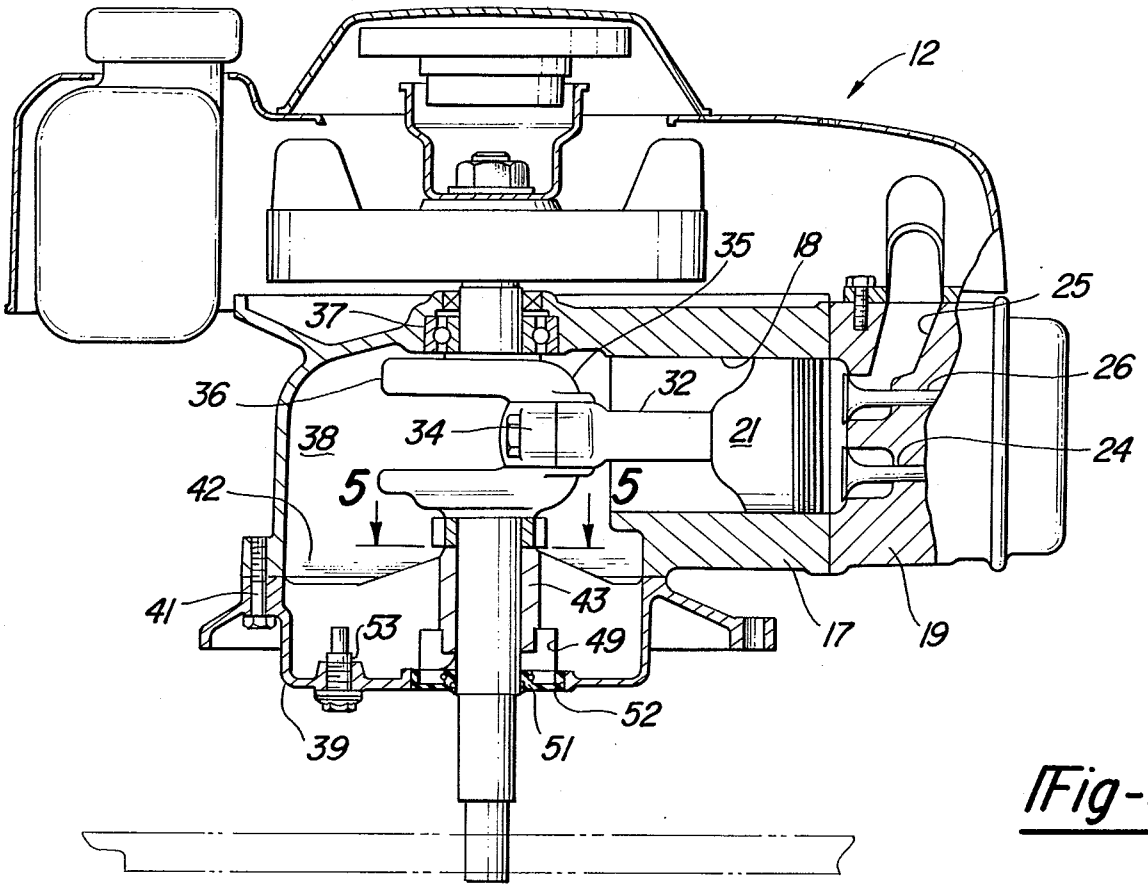
FIG. 3 is a cross-sectional view generally along the line 3—3 of FIG. 2.
Figures 4, 8:
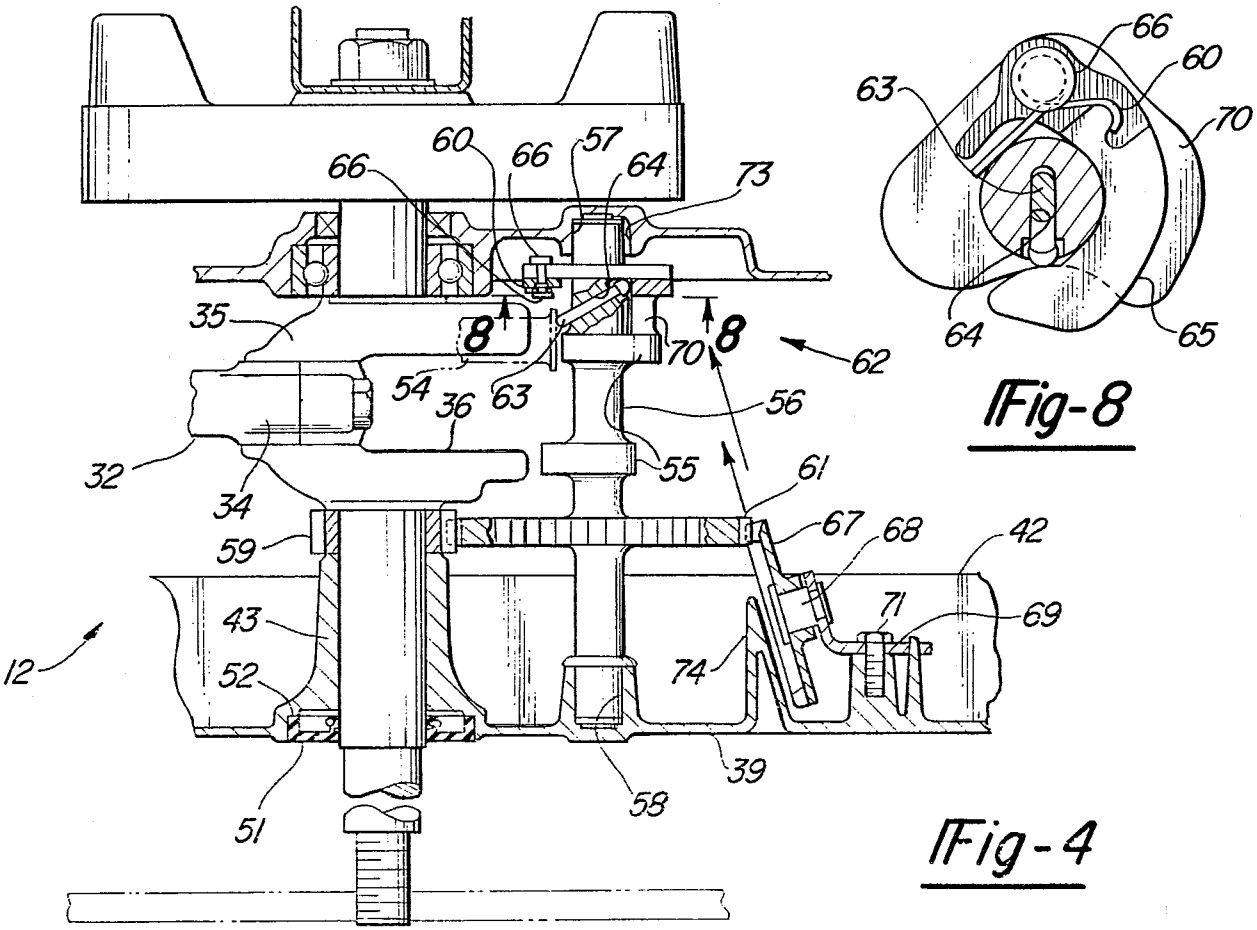
FIG. 4 is a cross-sectional view, on an enlarged scale taken generally along the line 4—4 of FIG. 2.
FIG. 8 is a cross-sectional view taken along the line 8—8 of FIG. 4.
Figure 6:
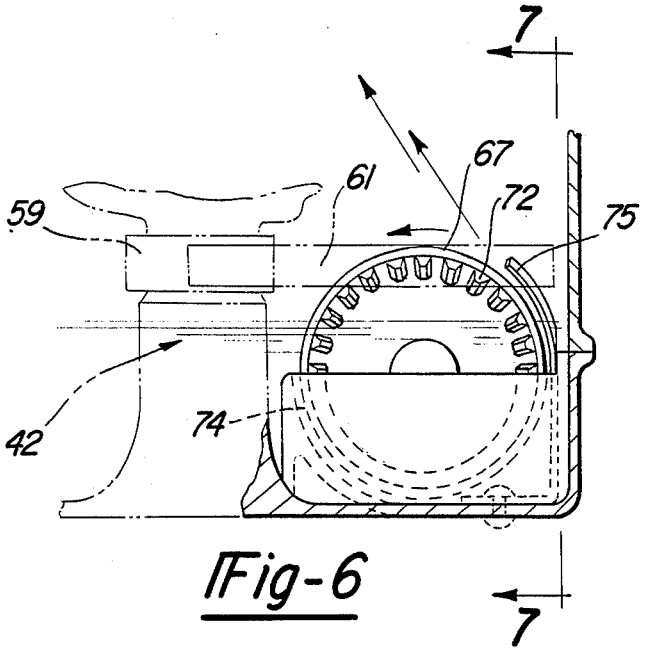
FIG. 6 is a cross-sectional view taken generally along the line 6—6 of FIG. 5.
Figure 7:
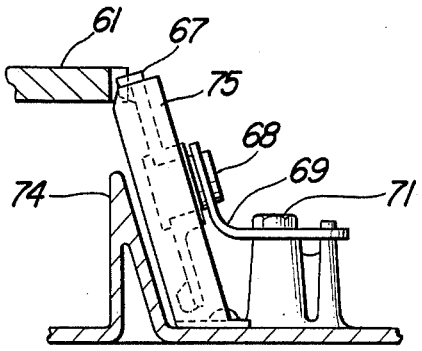
FIG. 7 is a cross-sectional view taken along the line 7—7 of FIG. 6.

Referring now in detail to the remaining figures of the drawings and initially to FIGS. 2 through 4, the construction of the engine 12 and specifically its lubrication system will be described.

The engine 12 is comprised of a cylinder block 17 that is formed with one horizontally disposed cylinder bore 18. A cylinder head 19 is affixed to the cylinder block 17 in a known manner and closes the end of the cylinder bore 18 above a piston 21 that is supported for reciprocation within the cylinder bore 18. An intake port 22 extends through the cylinder head 19 from a carburetor 23 which delivers a fuel/air charge to the intake port 22 in a known manner and terminates at an intake valve 24. In a similar manner, an exhaust port 25 extends through the cylinder head 19 from an exhaust valve 26 and communicates with an externally positioned muffler 27 for silencing and discharging the exhaust gases to the atmosphere.

The intake and exhaust valves 24 and 28 are operated by means of respective rocker arms 28 that are journaled on individual pivot shafts 29 carried by the cylinder head 19. Push rods 31 extend through the cylinder head 19 and cylinder block 17 and operate the rocker arms 28 for opening and closing the valves 24 and 26 in a known manner.

A connecting rod 32 is pivotally connected at one end to the piston 21 by means of a piston pin 33. The lower or big end 34 of the connecting rod 32 is journaled on a throw 35 of a crankshaft 36. The crankshaft 36 is journaled for rotation about a generally vertically extending axis by means which include an upper bearing 37 that is supported in the cylinder block 17 in a known manner.

The crankshaft 35 rotates in a crankcase chamber 38 which is formed in part by the cylinder block 17 and by means of a closure plate 39 that is affixed to the underside of the cylinder block 17 in a suitable manner as by bolts 41. The closure plate 39 and a portion of the cylinder block 17 and specifically the portion of the cylinder block 17 which defines the crankcase chamber 38 also defines a lubricant reservoir in which lubricant is filled to a level, indicated by the line 42.

Figure 5:
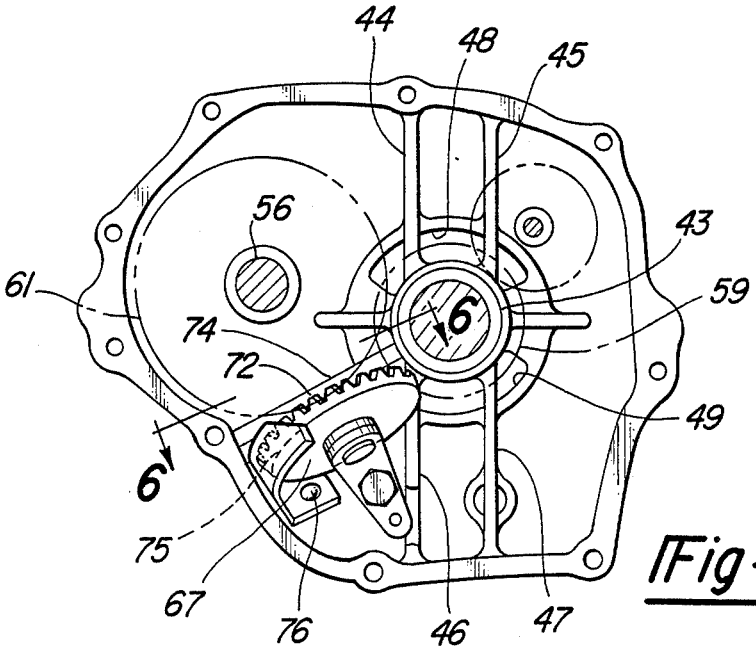
FIG. 5 is a cross-sectional view taken generally along the line 5—5 of FIG. 3.

Referring now additionally to FIG. 5, the lower plate 39 is formed with an elongated journal section 43 that forms an elongated bearing for the lower end of the crankshaft 35. The journal portion 43 extends from immediately adjacent the lower end of the plate 39 upwardly to a point slightly above the lubricant level 42. In order to provide rigidity for the bearing portion 43 and also so as to provide a baffling arrangement in the crankcase 38, there are provided transversely extending ribs 44, 45, 46 and 47 which are all form integrally with the bearing portion 43 and the remainder of the plate 39. To this end, the plate 39 may be formed conveniently as a casting.

It will be noted that the ribs 44, 45, 46 and 47 are disposed, at their upper ends, below the lubricant level 42 except immediately adjacent the bearing portion 43. Hence, the lubricant can communicate throughout the crankcase chamber 38 above the ribs 44, 45, 46 and 47 but the ribs have sufficient height so as to reduce the "sloshing" of lubricant within the crankcase 38. In addition, there are provided annular recesses or holes 48 and 49 that extend through the ribs 44, 45, 46 and 47 respectively so as to permit communication of the lubricant of the various chambers at an area at the lower portion of the ribs 44, 45, 46 and 47. This will ensure free flow through the entire crankcase chamber 38 while preventing "sloshing". In addition, this exposes the lower end of the crankshaft 35 below the bearing portion 43 with the lubricant.

A suitable oil seal 51 is contained within an annular opening 52 formed at the lower end of the plate 39 so as to provide good oil sealing and the ensure against leakage of lubricant from the oil reservoir portion. A drain plug 53 is also provided in the lower wall so as to permit draining of the lubricant from the lubricant reservoir.

As has been noted, the intake and exhaust valves 24 and 26 are operated by rocker arms 28 and push rods 31. The push rods 31 are, in turn, operated by means of tappets 54 (FIG. 2) that are slidably supported within the cylinder block 17 and are engaged by lobes 55 of a camshaft 56. The camshaft 56 is rotatably journaled in a upper bearing portion 57 formed in the cylinder block 17 and in a lower bearing portion 58 formed in the lower plate 39 (FIG. 4). Hence, the camshaft 56 rotates about an axis that is parallel to the rotational axis of the crankshaft 36. The camshaft 56 is driven at one-half of crankshaft speed by means of timing gears consisting of a first gear 59 that is affixed to the crankshaft 36 adjacent the bearing 43 and a second gear 61 that is either affixed to or formed integrally with the camshaft 56.

The engine is provided with a decompression device, indicated generally by the reference numeral 62 (FIGS. 4 and 8) for lifting the exhaust tappet 54 from the camshaft 56 under low speeds to reduce the compression in the engine and make the starting of it easier. The decompression device 62 includes a plunger 63 that is slidably supported in a transversely extending bore 64 of the camshaft 56 adjacent the lobe 55 that actuates the tappet 54 of the exhaust valve 26. The plunger 63 is engaged by a centrifugal weight 65 that is journaled by a pivot pin 66 on the camshaft 56 and biased by a torsional spring 50 so as to cause the plunger 63 to extend when the engine is not running or is turning over only at low speeds and lift the exhaust valve tappet 54 slightly so as to reduce the compression. As the engine begins to run, the centrifugal weight 65 will move outwardly and the plunger 63 can withdraw under centrifugal force so as to permit normal operation of the exhaust valve 26 once the engine is running. The centrifugal weight 65 is guided by a lug 70 on the camshaft 56 so as to control the pivotal movement.

As has been previously noted, the engine 12 is provided with a splash lubrication system and this includes an oil slinger 67 that is supported for rotation about a shaft 68 carried by a bracket 69 that is affixed to the lower plate 33 by means of a bolt 71. It should be noted that the oil slinger 67 is formed with gear teeth 72 that are enmeshed with the camshaft timing gear 61 for rotatably driving the slinger 67. The axis defined by the shaft 68 is neither vertical nor horizontal but is inclined to the horizontal as clearly shown in FIG. 4. The oil slinger 67 is disposed so that it will be immersed below the normal lubricant level 42 in the crankcase and will throw oil upwardly toward the decompression device 62, the upper end of the camshaft 56 and specifically its journal portion 57. The journal portion 57 is formed with a recess 73 that is adapted to receive this thrown oil and permit it to trickle down the camshaft 56 so as to lubricate the lobes 55 and tappets 54.

In order to prevent aeration of the lubricant in the crankcase 38 and to confine the flow of lubricant thrown by the slinger 67, the lower wall 39 is provided with an upstanding baffle portion 74 that extends immediately adjacent the gear teeth 72 of the slinger 67 and terminates at approximately the rotational axis of the slinger. This baffle 74 will confine the direction of lubricant flow and will, as has been noted, reduce the aeration of the lubricant in the crankcase 38. In addition, an oil guide plate 75 is affixed to the plate 39 by means of bolts 76 (FIG. 5) and extends around the oil slinger 67 from below the level of lubricant 42 to a point vertically upwardly so that the oil thrown by the slinger will be directed toward the camshaft bearing 57. This baffle arrangement consisting of the wall 74 and guide plate 75 are very effective in directing the lubricant flow while elminating frothing in the crankcase.

It should be readily apparent from the foregoing description that a very effective lubricating system is provided for an engine having an output shaft rotatable about a vertically extending axis and for ensuring that the lubricant will be appropriately directed toward the components to be lubricated and also so that there will be minimum frothing from the oil in the crankcase.

In addition, there is the insurance that oil "sloshing" in the crankcase will be minimized without interfering with the complete flow of lubricant to the various components of the engine to be lubricated and while maintaining an adequate lubricant head.

Various changes and modifications may be made without departing from the spirit and scope of the invention, as defined by the appended claims.

We claim:

1. In a lubrication system for an internal combustion engine having an output shaft rotatable about a generally vertically extending axis, a lubricant reservoir defined at least in part by a lower wall of said engine surrounding said output shaft and through which said output shaft passes for driving a driven element, said lower wall being formed with an upwardly extending baffle for dividing said lubricant reservoir into separate sections and for reducing sloshing of lubricant within said lubricant reservoir, and oil passage means extending through said baffle for permitting lubricant to flow therethrough.

2. In a lubrication system for an internal combustion engine as set forth in claim 1 wherein the baffle is integrally formed with a bearing rotatably journaling the engine output shaft.

3. In a lubrication system for an internal combustion engine as set forth in claim 2 wherein the lower wall is formed with a pair of generally parallel baffles each integrally connected to the output shaft bearing.

4. In a lubrication system for an internal combustion engine as set forth in claim 3 wherein the oil passage means comprise circumferential recesses formed in a lower face of the lower wall adjacent the baffles.

5. In a lubrication system for an internal combustion engine as set forth in claim 1 wherein the baffle extends transversely across the reservoir.

6. In a lubrication system for an internal combustion engine as set forth in claim 5 wherein the baffle is formed integrally with the lower wall.

7. In a lubrication system for an internal combustion engine as set forth in claim 6 wherein the lower wall is formed with a pair of generally parallel baffles each integrally connected to the output shaft bearing.

8. In a lubrication system for an internal combustion engine as set forth in claim 7 wherein the oil passage means comprise circumferential recesses formed in a lower face of the lower wall adjacent the baffles.

9. In a lubrication system for an internal combustion engine as set forth in claim 8 wherein the baffles are integrally connected to a bearing formed by the lower wall and journalling the output shaft.

10. In a lubrication system for an internal combustion engine as set forth in claim 1 further including an oil slinger driven by the engine output shaft and immersed in the oil reservoir.

11. In a lubrication system for an internal combustion engine as set forth in claim 10 wherein the oil slinger rotates about an axis that is inclined to the horizontal and wherein the lower wall is formed with a further baffle adjacent the oil slinger.

12. In a lubrication system for an internal combustion engine as set forth in claim 11 further including a camshaft driven by the engine output shaft by means of a pair of timing gears, the oil slinger having a gear engaged with the camshaft timing gear for driving the oil slinger.

13. In a lubrication system for an internal combustion engine as set forth in claim 10 further including a baffle plate extending around a portion of the circumference of the oil slinger for directing the oil thrown thereby.

14. In a lubrication system for an internal combustion engine as set forth in claim 13 wherein the oil slinger rotates about an axis that is inclined to the horizontal and wherein the lower wall is formed with a further baffle adjacent the oil slinger.

15. In a lubrication system for an internal combustion engine as set forth in claim 14 further including a camshaft driven by the engine output shaft by means of a pair of timing gears, the oil slinger having a gear engaged with the camshaft timing gear for driving the oil slinger.

16. In a lubrication system for an internal combustion engine having a generally horizontaly disposed cylinder extending from a crankcase, a crankshaft journaled for rotation within said crankcase about a generally vertically extending axis, an oil slinger rotatable about an axis disposed at an angle to both the horizontal and the vertical and at least in part submerged in the lubricant in said crankcase, means for driving said oil slinger from said camshaft, said oil slinger axis being disposed for directing lubricant thrown by said slinger toward the upper end of said camshaft and a baffle contained within said crankcase and juxtaposed to said slinger for confining the oil movement within the crankcase.

17. In a lubrication system for an internal combustion engine as set forth in claim 16 wherein the baffle extends generally perpendicularly to the axis of rotation of the oil slinger.

18. In a lubrication system for an internal combustion engine as set forth in claim 17 wherein the baffle is formed integrally with the crankcase.

19. In a lubrication system for an internal combustion engine as set forth in claim 18 further including a circumferential baffle fixed within the crankcase extending partially around the circumference of the oil slinger for directing the oil thrown thereby.

20. In a lubrication system for an internal combustion engine as set forth in claim 16 further including a circumferential baffle fixed within the crankcase extending partially around the circumference of the oil slinger for directing the oil thrown thereby.

* * * * *